US010793231B1

(12) United States Patent
Comstock

(10) Patent No.: US 10,793,231 B1
(45) Date of Patent: Oct. 6, 2020

(54) WEATHER MITIGATION ASSEMBLY

(71) Applicant: Carl Comstock, Clemont, FL (US)

(72) Inventor: Carl Comstock, Clemont, FL (US)

( * ) Notice: Subject to any disclaimer, the term of this patent is extended or adjusted under 35 U.S.C. 154(b) by 0 days.

(21) Appl. No.: 16/374,810

(22) Filed: Apr. 4, 2019

(51) Int. Cl.
*B63B 22/24* (2006.01)

(52) U.S. Cl.
CPC ..... *B63B 22/24* (2013.01)

(58) Field of Classification Search
CPC ..... B63B 22/24
See application file for complete search history.

(56) References Cited

U.S. PATENT DOCUMENTS 3,683,627 A * 8/1972 Girden ..... B01F 3/0412 405/52
4,662,781 A * 5/1987 Tinkler ..... E02B 1/003 405/79
7,520,237 B1 4/2009 Dimov
7,536,967 B2 5/2009 Barber
D690,389 S 9/2013 Doyle
2002/0009338 A1* 1/2002 Blum ..... A01G 15/00 405/303
2005/0031417 A1 2/2005 Hofer
2009/0272817 A1 11/2009 Blum

* cited by examiner

*Primary Examiner* — Stephen P Avila

(57) ABSTRACT

A weather mitigation assembly for reducing the surface temperature of the ocean to mitigate developing oceanic weather systems includes a buoy that is floated on the ocean. An air pump is coupled to the buoy and a plurality of tethers is each coupled between the buoy and the ocean floor for keeping the buoy in a selected spot. A network of bubble pipes is each laid along the ocean floor. A supply pipe is fluidly coupled between the air pump and the network of bubble pipes. In this way the air pump can pump air into the network of bubble pipes. Each of the bubble pipes releases air bubbles upwardly toward the surface of the ocean urge cool water on the ocean floor upwardly toward the surface of the ocean. In this way the surface of the ocean can be cooled thereby reducing thermal energy available for developing weather systems.

5 Claims, 4 Drawing Sheets

WEATHER MITIGATION ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mitigation devices and more particularly pertains to a new mitigation device for reducing the surface temperature of the ocean to mitigate developing oceanic weather systems.

BRIEF SUMMARY OF THE INVENTION

An embodiment of the disclosure meets the needs presented above by generally comprising a buoy that is floated on the ocean. An air pump is coupled to the buoy and a plurality of tethers is each coupled between the buoy and the ocean floor for keeping the buoy in a selected spot. A network of bubble pipes is each laid along the ocean floor. A supply pipe is fluidly coupled between the air pump and the network of bubble pipes. In this way the air pump can pump air into the network of bubble pipes. Each of the bubble pipes releases air bubbles upwardly toward the surface of the ocean urge cool water on the ocean floor upwardly toward the surface of the ocean. In this way the surface of the ocean can be cooled thereby reducing thermal energy available for developing weather systems.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
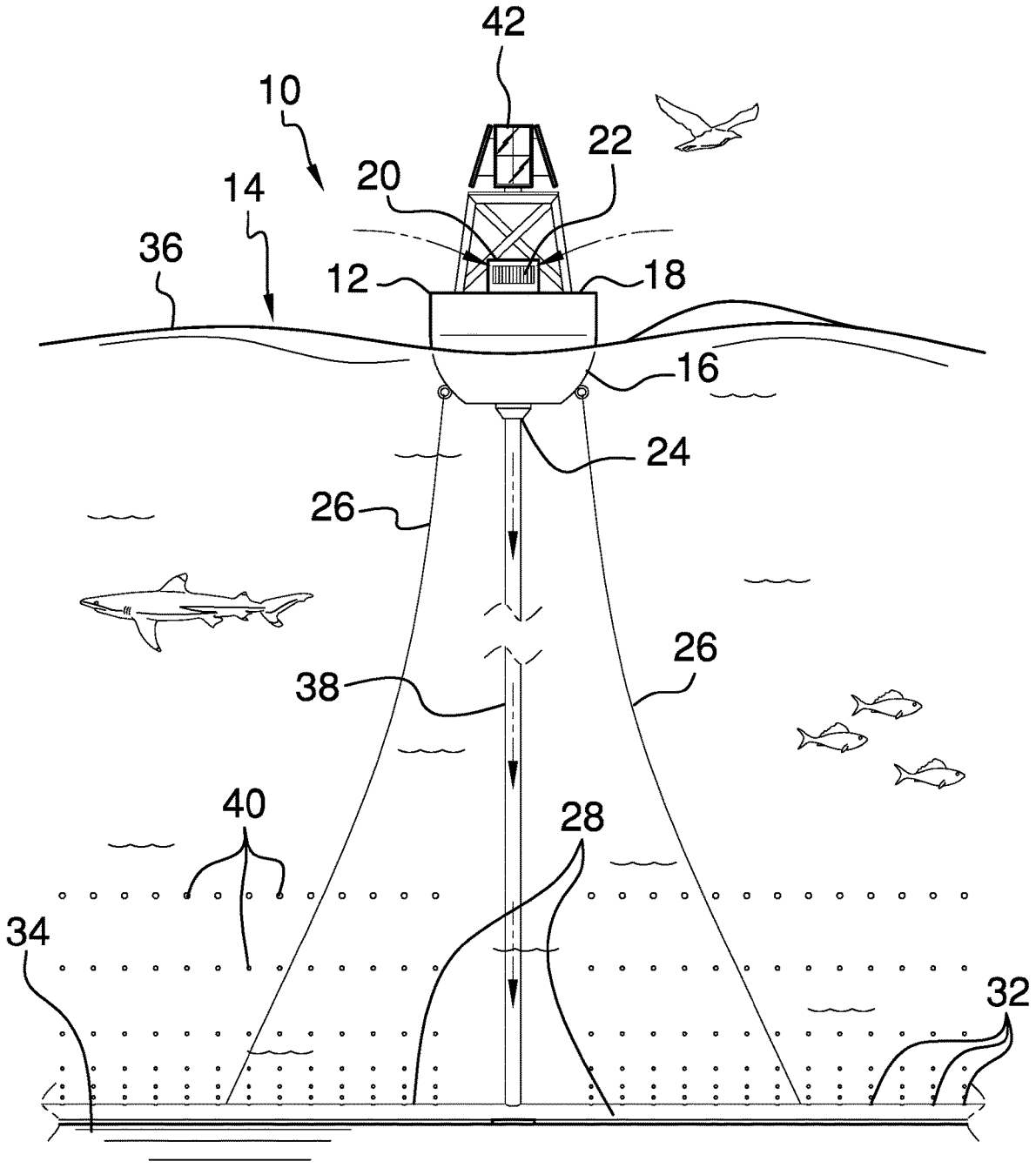
FIG. 1 is a perspective in-use view of a weather mitigation assembly according to an embodiment of the disclosure.
Figure 2:
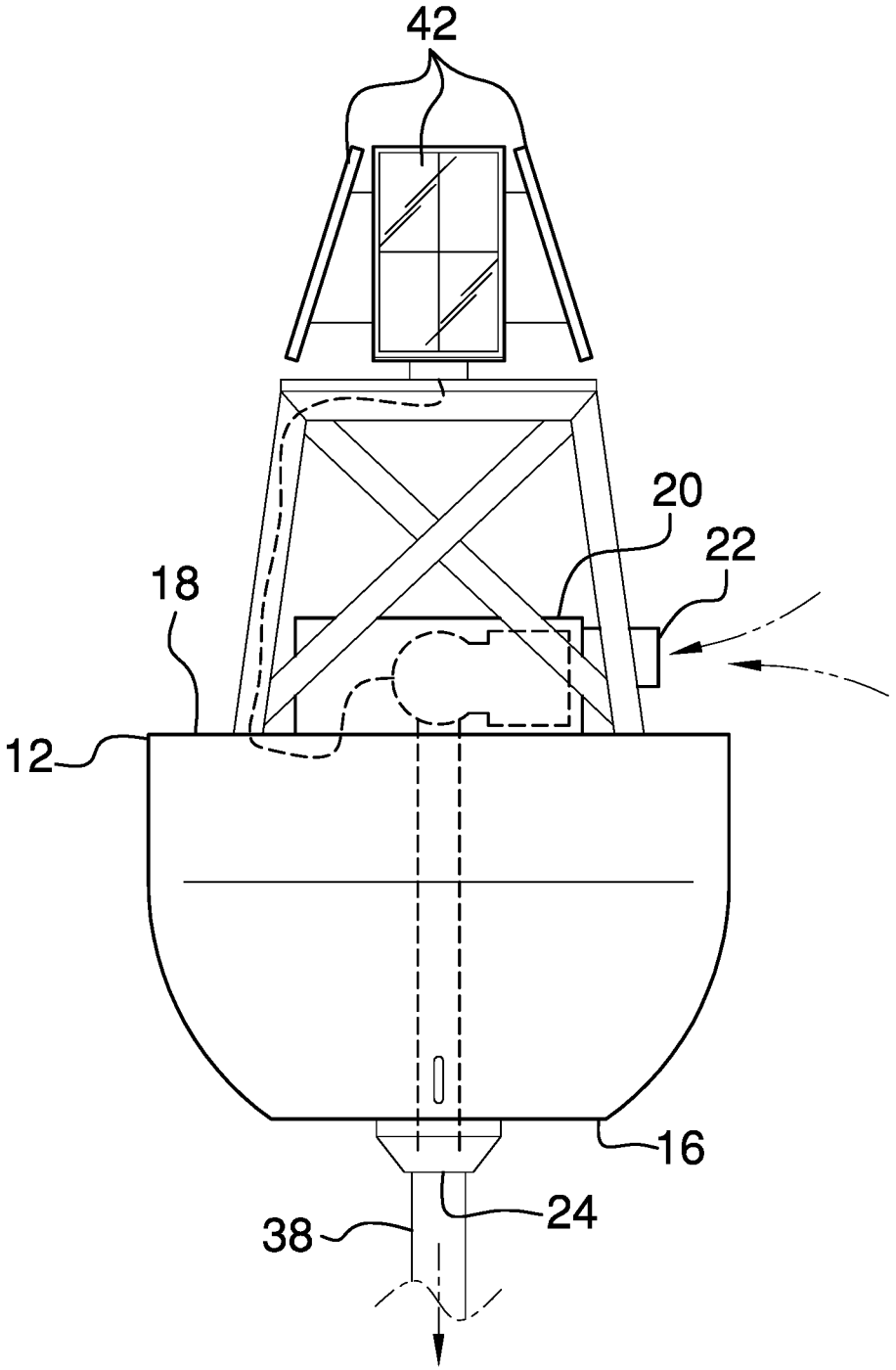
FIG. 2 is a perspective phantom view of a buoy of an embodiment of the disclosure.
Figure 3:
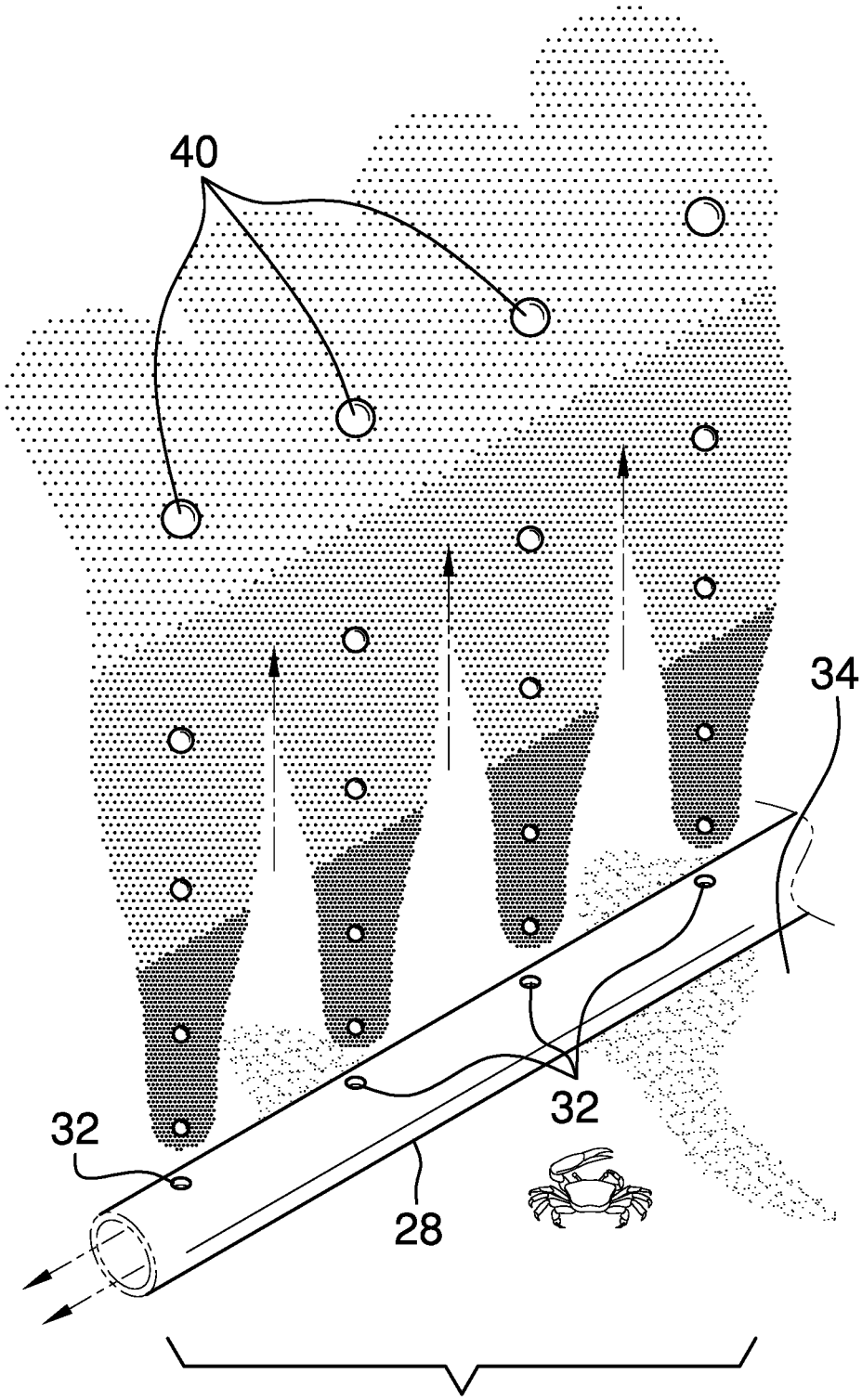
FIG. 3 is a perspective view of one of a network of bubble pipes an embodiment of the disclosure.
Figure 4:
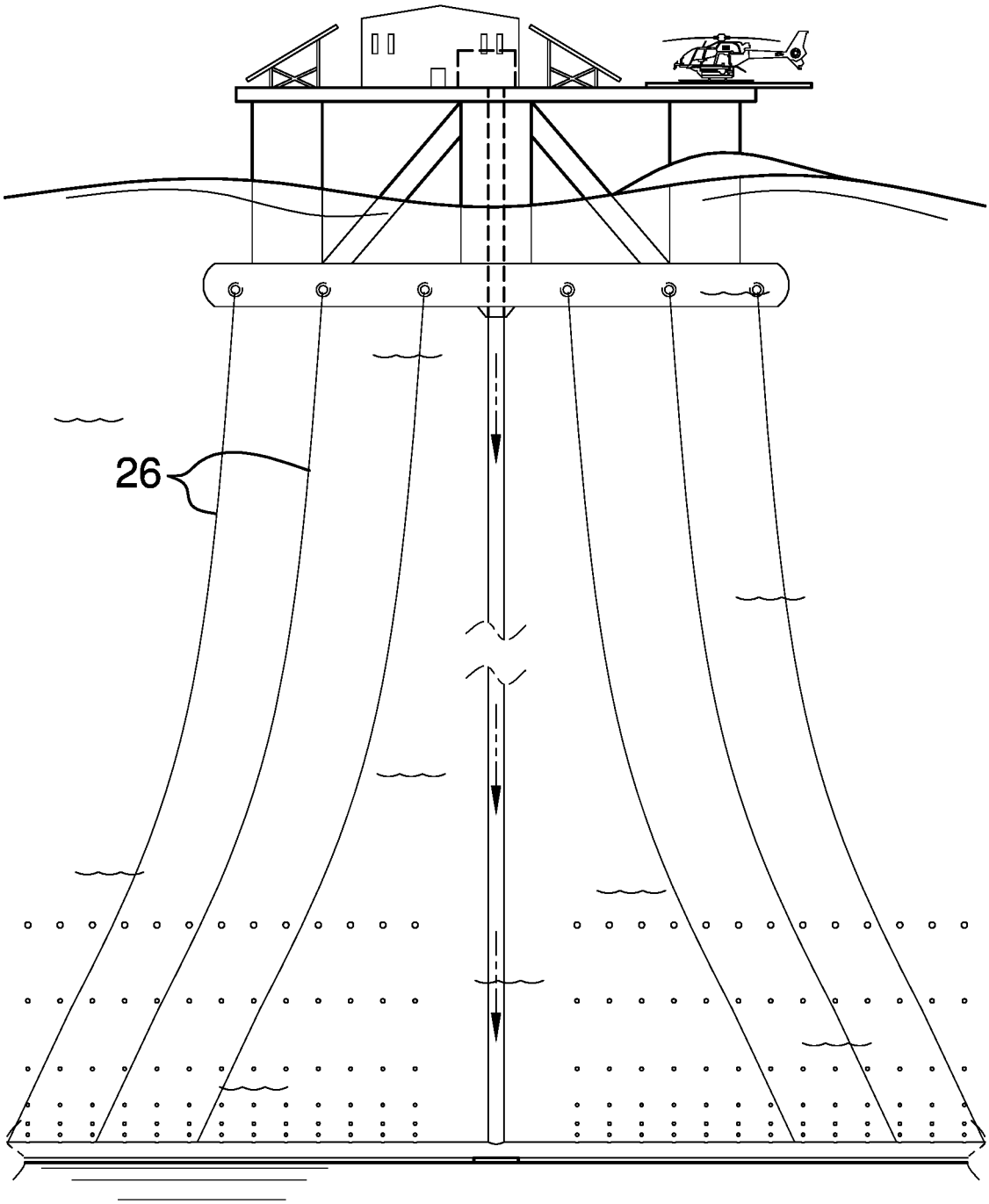
FIG. 4 is a perspective in-use view of an embodiment of the disclosure involving a platform in lieu of a buoy.

With reference now to the drawings, and in particular to FIGS. 1 through 4 thereof, a new mitigation device embodying the principles and concepts of an embodiment of the disclosure and generally designated by the reference numeral 10 will be described.

As best illustrated in FIGS. 1 through 4, the weather mitigation assembly 10 generally comprises a buoy 12 that is floated on the ocean 14, and the buoy 12 has a bottom side 16 that is submerged and a top side 18 is exposed. Additionally, as is most clearly shown in FIG. 4, a platform, such as is associated with an oil rig, may be provided in lieu of the buoy 12. An air pump 20 is coupled to the buoy 12 and the air pump 20 is positioned on the top side 18 of the buoy 12. The air pump 20 has an intake 22 and an exhaust 24. The intake 22 is positioned on the top of the buoy 12 and the exhaust 24 is positioned on the bottom side 16 of the buoy 12. The air pump 20 may be an electric air pump or the like. A plurality of tethers 26, such as cables or the like, is each coupled between the buoy 12 and the ocean floor 34 for keeping the buoy 12 in a selected spot. Additionally, each of the tethers 26 engages the bottom side 16 of the buoy 12.

A network of bubble pipes 28 is provided and each of the network of bubble pipes 28 is laid along the ocean floor 34. Each of the bubble pipes 28 has an outer wall 30 and the outer wall 30 of each of the bubble pipes 28 has a plurality of air apertures 32 extending into an interior of a respective one of the bubble pipes 28. The air apertures 32 are spaced apart from each other and are distributed along an entire length of the bubble pipes 28. Moreover, each of the bubble pipes 28 is oriented on the ocean floor 34 having the air apertures 32 being directed toward the surface of the ocean 36. The network of bubble pipes 28 may be arranged to radiate outwardly from a common central point or in any other geometric arrangement.

A supply pipe 38 is fluidly coupled between the air pump 20 and the network of bubble pipes 28 for directing air into the network of bubble pipes 28. The supply pipe 38 is fluid coupled to the exhaust 24 of the air pump 20 and each of the air apertures 32 in each of the network of bubble pipes 28 releasing air bubbles 40 upwardly toward the surface of the ocean 36 when the air pump 20 is turned on. Moreover, the air bubbles 40 released by the bubble pipes 28 urges cool water on the ocean floor 34 upwardly toward the surface of the ocean 36. In this way the surface of the ocean 36 can be cooled thereby reducing thermal energy available for developing weather systems.

A power supply 42 is coupled to the buoy 12 and the power supply 42 is electrically coupled to the air pump 20. The power supply 42 comprises a plurality of solar panels 44 that is each directed upwardly from the top side 18 of the buoy 12. In this way each of the solar panels 44 can be exposed to sunlight. Additionally, the power supply 42 may include at least one battery for storing power generated by the solar panels 44.

In use, the buoy 12, the network of bubble pipes 28 and the supply pipe 38 are positioned on the ocean 14 proximate a location that is commonly threatened by oceanic weather systems. The air pump 20 is turned on when a potentially threatening oceanic weather system is developing. Thus, the air pump 20 pumps air downwardly through the supply pipe 38 to subsequently be released through the air apertures 32 in the network of bubble pipes 28. Thus, the air bubbles 40 released from the bubble pipes 28 urges cool water at the ocean floor 34 upwardly toward the surface of the ocean 36 to cool the surface of the ocean 36. In this way the thermal energy at the surface of the ocean 36 that is available for the oceanic weather system is reduced, thereby causing the oceanic weather system to weaken prior to making landfall. The air pump 20 is turned off when no oceanic weather system is developing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weather mitigation assembly being configured to urge cold water from the bottom of the ocean upwardly toward the surface of the ocean for cooling the surface of the ocean and thusly depriving weather systems of thermal energy, said assembly comprising:

a buoy being floated on the ocean, said buoy having a bottom side being submerged and a top side being exposed;

an air pump being coupled to said buoy, said air pump being positioned on said top side of said buoy, said air pump having an intake and an exhaust, said intake being positioned on said top said of said buoy, said exhaust being positioned on said bottom side of said buoy;

a plurality of tethers, each of said tethers being coupled between said buoy and the ocean floor for keeping said buoy in a selected spot;

a network of bubble pipes, each of said bubble pipes being laid along the ocean floor; and a supply pipe being fluidly coupled between said air pump and said network of bubble pipes wherein said air pump is configured to pump air into said network of bubble pipes, each of said bubble pipes releasing air bubbles upwardly toward the surface of the ocean wherein said bubble pipes are configured to urge cool water on the ocean floor upwardly toward the surface of the ocean for cooling the water at the surface of the ocean thereby reducing thermal energy available for developing weather systems.

2. The assembly according to claim 1, wherein each of said bubble pipes has an outer wall, said outer wall of each of said bubble pipes having a plurality of air apertures extending into an interior of a respective one of said bubble pipes, said air apertures being spaced apart from each other and being distributed along an entire length of said bubble pipes, each of said bubble pipes being oriented on the ocean floor having said air apertures being directed toward the surface of the ocean.

3. The assembly according to claim 1, further comprising a power supply being coupled to said buoy, said power supply being electrically coupled to said air pump, said power supply comprising a plurality of solar panels each being directed upwardly from said top side of said buoy wherein each of said solar panels is configured to be exposed to sunlight.

4. A weather mitigation assembly being configured to urge cold water from the bottom of the ocean upwardly toward the surface of the ocean for cooling the surface of the ocean and thusly depriving weather systems of thermal energy, said assembly comprising:

a buoy being floated on the ocean, said buoy having a bottom side being submerged and a top side being exposed;

an air pump being coupled to said buoy, said air pump being positioned on said top side of said buoy, said air pump having an intake and an exhaust, said intake being positioned on said top said of said buoy, said exhaust being positioned on said bottom side of said buoy;

a plurality of tethers, each of said tethers being coupled between said buoy and the ocean floor for keeping said buoy in a selected spot, each of said tethers engaging said bottom side of said buoy;

a network of bubble pipes, each of said bubble pipes being laid along the ocean floor, each of said bubble pipes having an outer wall, said outer wall of each of said bubble pipes having a plurality of air apertures extending into an interior of a respective one of said bubble pipes, said air apertures being spaced apart from each other and being distributed along an entire length of said bubble pipes, each of said bubble pipes being oriented on the ocean floor having said air apertures being directed toward the surface of the ocean;

a supply pipe being fluidly coupled between said air pump and said network of bubble pipes wherein said air pump is configured to pump air into said network of bubble pipes, said supply pipe being fluid coupled to said exhaust of said air pump, each of said air apertures in each of said network of bubble pipes releasing air bubbles upwardly toward the surface of the ocean wherein said bubble pipes are configured to urge cool water on the ocean floor upwardly toward the surface of the ocean for cooling the water at the surface of the ocean thereby reducing thermal energy available for developing weather systems; and a power supply being coupled to said buoy, said power supply being electrically coupled to said air pump, said power supply comprising a plurality of solar panels each being directed upwardly from said top side of said buoy wherein each of said solar panels is configured to be exposed to sunlight.

5. A method of mitigating developing oceanic weather systems, said method comprising the steps of:

providing a buoy being floated on the ocean, said buoy having a bottom side being submerged and a top side being exposed;

providing an air pump being coupled to said buoy, said air pump having an intake being positioned on said top side of said buoy and an exhaust being positioned on said bottom side of said buoy;

providing a network of bubble pipes, each of said network of bubble pipes having a plurality of air apertures therein;

positioning said network of bubble pipes on the ocean floor below said buoy having said air apertures being directed toward the surface of the ocean;

providing a supply pipe;

fluidly coupling said supply pipe between said exhaust of said air pump and said network of bubble pipes; and turning on said air pump when a threatening oceanic weather system is developing thereby urging air bubbles upwardly from said network of bubble pipes such that the air bubbles urge cold water from the ocean floor upwardly toward the surface of the ocean for cooling the surface of the ocean and subsequently reducing thermal energy available for the oceanic weather system to develop.

* * * * *